United States Patent [19]

Flanagan et al.

[11] 4,187,781

[45] Feb. 12, 1980

[54] CASELESS AMMUNITION

[75] Inventors: Joseph E. Flanagan, Woodland Hills; George A. Lo, Canoga Park, both of Calif.

[73] Assignee: Rockwell International Corporation, El Segundo, Calif.

[21] Appl. No.: 306,960

[22] Filed: Nov. 13, 1972

[51] Int. Cl.[2] ..... E21B 43/06

[52] U.S. Cl. ..... 102/38 CC; 149/16

[58] Field of Search ..... 102/DIG. 1, 40, 38; 149/16; 102/38 CC, 40

[56] References Cited

U.S. PATENT DOCUMENTS

| | | | |
|---|---|---|---|
| 3,397,637 | 8/1968 | Bobinski et al. | 102/DIG. 1 |
| 3,645,206 | 2/1972 | Quinlan et al. | 102/DIG. 1 |
| 3,705,549 | 12/1972 | Quinlan et al. | 102/DIG. 1 |

*Primary Examiner*—Stephen J. Lechert, Jr.

*Attorney, Agent, or Firm*—L. Lee Humphries; Robert M. Sperry

[57] ABSTRACT

A round of ammunition is formed by molding multiple layers of propellant about the sides and rear of a projectile providing an inner layer of conventional propellant enclosed within an outer layer composed of a mixture of a polynitroaromatic material, such as diaminotrinitrobenzene (DATB), as the primary oxidizer, and a phosphorus-containing hydroxy-terminated polyether binder.

9 Claims, 2 Drawing Figures

CASELESS AMMUNITION

BACKGROUND OF THE INVENTION

1. Field of the Invention

This invention relates to ammunition and is particularly directed to caseless ammunition formed by molding multiple layers of propellant about the sides and rear of a projectile.

2. Prior Art

Heretofore, it has been conventional for ammunition, especially small arms ammunition, to comprise a metal cartridge or shell case containing a projectile and a quantity of propellant. Generally, the propellant was granular and the metal case, which was usually formed of brass, served to retain the propellant and to protect the propellant against mechanical shock and atmospheric degradation due to moisture, heat and the like. Unfortunately, brass is expensive and, especially during wartime, is often difficult to obtain. Moreover, the metal adds considerably to the weight of the ammunition, yet contributes nothing to its performance.

In order to overcome these disadvantages, it has been suggested that the metal cartridge cases be replaced by cases made of nitrocellulose. However, it has been found that these materials tend to ignite inadvertently, as when placed in a hot gun or when adjacent rounds of ammunition are ignited. More recently, with the development of castable solid propellants, such as are used in rocket motors and the like, it has been suggested that single grain propellants could be cast about the projectile to eliminate the need for metal cartridge cases. Unfortunately, those propellant materials which satisfy the mechanical and atmospheric requirements are either subject to the same disadvantages as the nitrocellulose cartridge cases or yield greatly reduced performance. Thus, none of the prior art techniques for providing caseless ammunition have been entirely satisfactory.

BRIEF SUMMARY AND OBJECTS OF INVENTION

These disadvantages of the prior art are overcome with the present invention and a caseless cartridge is provided which has good mechanical properties, resists atmospheric degradation and inadvertent ignition, yet provides the desired performance.

The advantages of the present invention are preferably attained by providing a caseless cartridge comprising a projectile and a multi-layered propellant case about the sides and rear of the projectile and formed with an outer layer composed of a polynitroaromatic material, such as diaminotrinitrobenzene (DATB), in a phosphorus-containing hydroxy-terminated polyether binder, having superior mechanical and thermal properties, and an inner layer composed of a material such as conventional gun propellants, having poorer mechanical and thermal stability characteristics than the outer layer but providing desired ballistic properties.

Accordingly, it is an object of the present invention to provide improved ammunition.

Another object of the present invention is to provide improved caseless ammunition.

An additional object of the present invention is to provide caseless ammunition which resists inadvertent ignition, while providing satisfactory ballistic performance.

A specific object of the present invention is to provide a cartridge comprising a projectile and a multilayered propellant cast about the sides and rear of the projectile including an outer layer composed of a polynitroaromatic material in a phosphorus-containing hydroxyterminated polyether binder, and an inner layer composed of a conventional propellant.

These and other objects and features of the present invention will be apparent from the following detailed description, taken with reference to the accompanying drawing.

DETAILED DESCRIPTION OF INVENTION

Figure 1:
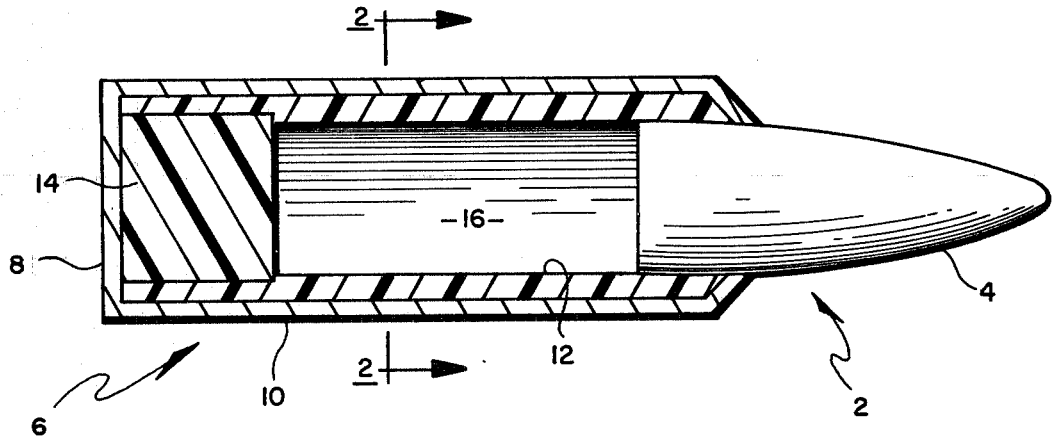
FIG. 1 is a vertical section through a cartridge embodying the present invention.
Figure 2:
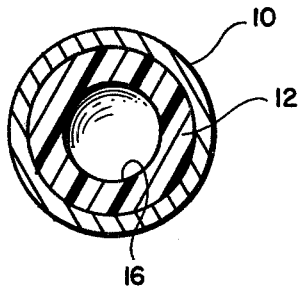
FIG. 2 is a transverse section through the cartridge of FIG. 1.

In that form of the present invention chosen for purposes of illustration in the drawing, FIG. 1 shows a caseless cartridge, indicated generally at 2, having a projectile 4. A multi-layered propellant charge, indicated generally at 6, is cast, as with a mold and die, about the sides of the projectile 4 and projects rearwardly therefrom in the form of a hollow cylinder which is open at its rear end 8. Alternatively, the propellant charge 6 may be cast independently prior to assembly with the projectile 4. The propellant charge 6 is formed of an outer layer 10 and an inner layer 12. Finally, a primer 14 is mounted within the rear end 8 of the propellant charge 6 and serves to form a chamber 16 within the cylinder formed by the propellant charge 6. The dimensions of the chamber 16 may be varied widely, depending, for example, upon the caliber of the weapon and the desired ballistic properties. The primer 14 may be substantially any conventional percussion-type primer material, such as 88 weight percent lead stythanate and 12 weight percent nitrocellulose.

As indicated above, the propellant charge 6 is composed of an outer layer 10 and an inner layer 12. Moreover, it will be seen that the outer layer 10 covers the entire exterior surface of the inner layer 12 and primer 14. Thus, the outer layer 10 serves to retain and protect the inner layer 12 in substantially the same manner as that in which the metal case protects the propellant of a conventional cartridge. Consequently, the inner layer 12 may be composed of a conventional propellant, such as Improved Military Round (IMR) available commercially from DuPont de Nemours, E.I., & Co. (Inc.), Wilmington, Delaware.

The outer layer 10 is composed of a polynitroaromatic propellant, as an oxidizer, and a phosphorus-containing hydroxyterminated polyether binder.

Appropropriate materials which may be employed as the oxidizer are diaminotrinitrobenzene (DATB), available commercially from Chemtronics, Inc. of Ashville, North Carolina, or guanadine picrate (GP), available commercially from Eastman Kodak Co. of Rochester, New York. The binder may be substantially any phosphorus-containing hydroxy-terminated polyether material, such as RO-350 or X3090, available commercially from Union Carbide Co. of South Charleston, West Virgina. The ratio of the oxidizer and binder may be varied considerably to provide desired characteristics. Thus, the outer layer 10 may comprise 65–75 weight percent of oxidizer and 25–35 weight percent of binder.

In addition, the thickness of the outer layer may be varied substantially as desired. However, it is found that the outer layer 10 must have a minimum thickness of at least 0.02 inches in order to provide the requisite structural integrity and protection of the inner layer 12. It will be seen that the relative thicknesses of the outer layer 10 and inner layer 12 may be varied, substantially as desired, depending upon the desired ballistic properties of the ammunition. If desired, up to about 10 weight percent cyclotetramethylene tetranitramine (HMX) can be substituted for an equivalent amount of the DATB to improve the mass impetus, while retaining the self-extinguishing properties of the DATB.

As indicated above, the materials forming the primer 14 and the inner layer 12 of the propellant may be conventional. Thus, it is the properties of the outer layer 10 of the propellant which must provide the characteristics needed for satisfactory caseless ammunition.

Obviously, hydrolytic stability is one of the most important requirements of the material of the outer layer 10 of propellant and it is found that this can be controlled by regulating the degree of cure of the binder, i.e., the NCO/OH ratio or by the addition of polyols, such as TP-340, a polyoxypropylene trimethylolpropane, available commercially from Wyandotte Chemical Corp. Wyandotte, Michigan. Since the polynitroaromatic materials are not affected by water, it is only the binder material which is of concern. In a series of tests, samples of the RO-350 binder having various degrees of cure and various polyol additives were allowed to remain for three days in either an atmosphere of 100% humidity or completely immersed in water. As a result of these tests, it was found that little or no change in physical properties resulted in samples of pure RO-350 having NCO/OH ratios in the range of 1.25 to 1.40 or in samples of 50 weight percent RO-350 and 50 weight percent TP-340 having a NCO/OH ratio of 1.15. Samples containing as little as 10 weight percent of TP-340, but having the same degree of cure, showed no effects from the exposure to humidity, but showed some softening and milkiness after the water immersion test.

Another property required for the material of the outer layer 10 is thermal stability. That is, the material should have a high autoignition temperature and be self-extinguishing at ambient temperatures. To examine this property, a sample containing 65 weight percent DATB and 35 weight percent RO-350 was tested and found to have a five second autoignition temperature of 590° F. To test the self-extinguishing characteristics, attempts were made to ignite samples of the material by means of black powder and a hot wire. However, the samples consistently refused to ignite, even when the weight percentage of RO-350 was as low as 21%. Samples containing 17.5 and 14 weight percent of of RO-350 showed inconsistent results. Pressure deflagration tests showed that the ignition threshold for the 65 weight percent DATB is in the range of 55–60 pounds per square inch. Moreover, experiments with 5.56 mm. caseless rounds, formed in accordance with FIG. 1 wherein the outer layer 10 was composed of a 0.03 inch layer of 65 weight percent DATB and 35 weight percent RO-350, have shown in repeated trials that no flame propagation occurred between two adjacent rounds when one of the rounds is deliberately ignited.

Other mechanical and ballistic properties of caseless ammunition wherein the outer layer 10 is composed of 65 weight percent DATB and 35 weight percent RO-350 are shown in the following table.

TABLE I

| PROPELLANT PROPERTIES | |
|---|---|
| Impact Sensitivity $E^*_{10}$ (in-lb) | >250 |
| $P_{DL}$ (psi) | 55 |
| 5 sec Autoignition Temperature (° F.) | 590 |
| Vacuum Thermal Stability (gas evolution - cc/g/hr at 90° C.) | $4.0 \times 10^{-3}$* |
| Weight Loss (after 96 hours at 100° c.) | 8.6% |
| Tensile Strength (psi) | 500–900** |
| Elongaton (%) | 1–2** |
| Burn Rate ($r_{1000}$) in/sec | 0.07 |
| Impetus ($Im \times 10^{-3}$ ft-lb/lb) | 234*** |

*This value is lowered to $2.0 \times 10^{-3}$ cc/g/hr by tailoring the binder by blending the RO-350 with another phosphorus binder X3090.
**The mechanical properties can also be varied ($\sigma_{max}$ = 500 − 130 psi; $\epsilon_{max}$ = 1 − 35%) by tailoring the binder system.
***The theoretical impetus of a multilayered caseless gun propellant system containing 80 IMR/20 (65 DATB/35 RO-350) is 315,000 ft-lb/lb.

From the foregoing, it appears that caseless ammunition formed in accordance with FIG. 1 and having the outer layer 10 composed of a polynitroaromatic material with a phosphorus-containing polymeric binder is extremely satisfactory and useful.

Obviously, numerous variations and modifications may be made without departing from the present invention. Accordingly, it should be clearly understood that the form of the present invention described above and shown in the accompanying drawings is illustrative only and is not intended to limit the scope of the present invention.

What is claimed is:

1. In caseless ammunition comprising:
a projectile,
a hollow cylinder disposed about the sides of said projectile and extending rearwardly therefrom and formed of a layer composed of a conventional propellant and an outer layer covering the exterior surface of said inner layer, and
a primer closing the rear end of said cylinder;
the improvement consisting of forming said outer layer of a polynitroaromatic material with a phosphorus-containing hydroxy-terminated polyether binder.

2. The caseless ammunition of claim 1 wherein said polynitroaromatic material is diaminotrinitrobenzene.

3. The caseless ammunition of claim 1 wherein said outer layer comprises:
65–75 weight percent diaminotrinitrobenzene, and
25–35 weight percent of a phosphorus containing hydroxy-terminated polyether.

4. The caseless ammunition of claim 1 wherein the thickness of said outer layer is at least about 0.02 inch.

5. The caseless ammunition of claim 3 wherein said outer layer comprises:
at least 65 weight percent diaminotrinitrobenzene,
up to 10 weight percent cyclotetramethylene tetranitramine, and
at least 25 weight percent phosphorus containing hydroxy-terminated polyether.

6. The caseless ammunition of claim 3 wherein said polyether has a NCO/OH ratio in the range of 1.25–1.40.

7. The caseless ammunition of claim 1 wherein said binder comprises:
50 weight percent of a phosphorus containing hydroxy-terminated polyether, and
50 weight percent of a polyol.

8. The caseless ammunition of claim 7 wherein said polyol is a polyoxypropylene trimethylolpropane.

9. The caseless ammunition of claim 8 wherein said binder has a NCO/OH ratio of 1.15.

* * * * *